US007182274B2

(12) United States Patent
Nies

(10) Patent No.: US 7,182,274 B2
(45) Date of Patent: Feb. 27, 2007

(54) MULTI-MODE TRAVELING SPRINKLER

(75) Inventor: Juergen Nies, Winchester, VA (US)

(73) Assignee: Melnor, Inc., Winchester, VA (US)

( * ) Notice: Subject to any disclaimer, the term of this patent is extended or adjusted under 35 U.S.C. 154(b) by 473 days.

(21) Appl. No.: 10/715,864

(22) Filed: Nov. 16, 2003

(65) Prior Publication Data

US 2005/0103885 A1 May 19, 2005

(51) Int. Cl.
*B65H 75/00* (2006.01)

(52) U.S. Cl. ..... 239/198; 239/745; 239/747; 239/748

(58) Field of Classification Search ..... 239/743, 239/744, 745, 747, 748, 754, 195–198
See application file for complete search history.

(56) References Cited

U.S. PATENT DOCUMENTS

| | | | | | |
|---|---|---|---|---|---|
| 1,881,539 | A | | 10/1932 | Harris | |
| 1,919,703 | A | * | 7/1933 | Nielsen | 239/67 |
| 2,094,872 | A | * | 10/1937 | Crawford | 137/355.26 |
| 2,218,964 | A | * | 10/1940 | Wilson | 239/749 |
| 2,493,528 | A | * | 1/1950 | Crowder | 239/745 |
| 2,540,556 | A | | 2/1951 | Salatin | |
| 2,602,696 | A | | 7/1952 | Salatin | |
| 2,683,056 | A | | 7/1954 | Hilfinger | |
| 3,126,156 | A | * | 3/1964 | Rinkewich | 239/748 |
| 3,176,923 | A | * | 4/1965 | Simmons | 239/748 |
| 3,430,859 | A | | 3/1969 | Chow | |
| 3,643,442 | A | | 2/1972 | Houston | |
| 3,785,563 | A | * | 1/1974 | Maple | 239/748 |
| 4,346,842 | A | | 8/1982 | Botha | |
| 4,488,683 | A | | 12/1984 | Chiel | |
| 4,671,315 | A | | 6/1987 | Gardner | |
| 5,628,341 | A | * | 5/1997 | Bodden | 137/355.26 |
| 5,711,490 | A | | 1/1998 | Hansinger | |

* cited by examiner

*Primary Examiner*—Christopher Kim
(74) *Attorney, Agent, or Firm*—Akerman Senterfitt

(57) ABSTRACT

Aspects of the invention relate to a sprinkler apparatus providing multiple operational modes. For instance, the apparatus can operate as a conventional traveling sprinkler. In addition, the apparatus can provide one or more additional ports so that a user can attach additional hoses or other watering or irrigation equipment. The apparatus can include a switch so that a user can selectively switch a valve so that a fluid flows substantially exclusively to one of these additional ports. In one embodiment, a hose or other fluid dispensing device can be attached to one of the additional ports so that an operator can wash a car, water hanging pots, or perform other watering functions that cannot be accomplished by a traveling sprinkler.

16 Claims, 6 Drawing Sheets

MULTI-MODE TRAVELING SPRINKLER

CROSS-REFERENCE TO RELATED APPLICATIONS (Not Applicable)

STATEMENT REGARDING FEDERALLY SPONSORED RESEARCH OR DEVELOPMENT (Not Applicable)

FIELD OF THE INVENTION

The invention relates in general to watering devices and, more particularly, to traveling sprinklers.

BACKGROUND OF THE INVENTION

Traveling sprinklers are known in the art. Examples of traveling sprinkler devices are disclosed in U.S. Pat. No. 3,126,156 ("the '156 patent"); U.S. Pat. No. 3,430,859 ("the '859 patent"); U.S. Pat. No. 2,683,056 ("the '056 patent"); and U.S. Pat. No. 5,711,490 ("the '490 patent"), which are incorporated herein by reference. Such sprinkler systems can be used to irrigate land in various domestic, agricultural and other settings.

While traveling sprinklers are often multi-part assemblages, such devices commonly include at least the following components: a wheeled frame, a hose reel rotatably mounted on the wheeled frame, a rotatable sprinkler head, and a drive for transmitting the rotation of the sprinkler to the hose reel. The assembly can also provide a coupling to which one end of a hose or other fluid supply conduit can be connected. At least a portion of the remaining length of the hose can be wrapped around the hose reel. The other end of the hose can be connected to a fluid source, such as an outdoor water faucet. The assembly can further include a routing conduit, extending between the coupling and the sprinkler head, for directing a fluid received from the hose to the sprinkler head.

In operation, the sprinkler assembly can be reeled out to a desired spot in a yard. At that point, the assembly could be set to operate as a moving sprinkler. Water enters and is discharged from the sprinkler head, causing the sprinkler head to rotate as is known in the art; the motion of the sprinkler head can then be used to propel the sprinkler assembly. For instance, the rotating sprinkler head can drive a gearbox that rotates the hose reel so as to wrap the length of hose around the hose reel as the assembly rolls back to the water source. As it travels, the sprinkler assembly can use the uncoiled portion of the hose as a track to guide the assembly.

Such sprinkler systems can save a user the manual effort of winding the hose back up after watering. Further, the sprinkler system allows the user to design a desired watering path and obtain coverage that a fixed or static sprinkler system could not ordinarily achieve. While providing these and other advantages, previous traveling sprinkler systems are limited because they can only be used as sprinklers. From the perspective of a consumer, this lone operational mode may not justify the expense of the device. Thus, there is a need for a traveling sprinkler that can provide additional uses or functions, particularly watering or irrigation-related functions.

SUMMARY OF THE INVENTION

Embodiments of the invention relate to a traveling sprinkler apparatus. The traveling sprinkler includes a wheeled frame, a hose reel rotatably mounted on the frame, a rotatable sprinkler head, and a transmission for communicating the rotation of the sprinkler to the hose reel such that the hose reel rotates. The transmission can include at least a plurality of gears. The traveling sprinkler further includes a flow control valve, supply piping, sprinkler piping and discharge piping.

The flow control valve, which can be a ball valve, is movable at least between a first position and a second position. In the first position, fluid communication is permitted substantially exclusively between the supply piping and the discharge piping. As a result, the sprinkler apparatus does not travel. When the valve is in the second position, fluid communication is permitted substantially exclusively between the supply piping and the sprinkler piping. Thus, a fluid can enter and be discharged from the sprinkler head such that the sprinkler head rotates, which, by way of the transmission, causes the sprinkler apparatus to travel. In some embodiments, the valve can further be movable to a third position, in which the supply piping is substantially restricted from fluidly communicating with both the discharge piping and the sprinkler piping. In such case, the sprinkler apparatus can remain stationary and substantially no water or fluid would be discharged from the device.

The supply piping has an inlet end and extends to the flow control valve. The inlet end of the supply piping can include a coupling adapted for connection to a hose. The coupling can be located on the hose reel. The coupling can include one of threads or quick disconnects. The sprinkler piping extends between the flow control valve and the sprinkler head. The discharge piping extends from the flow control valve to an outlet end. The outlet end of the discharge piping can include a coupling adapted for connection to one of a hose or a fluid dispensing device. The coupling can include one of threads or quick connect/disconnects.

The traveling sprinkler can further include a flow control switch. The flow control switch can be operatively connected to the flow control valve so as to move the flow control valve between the first and second positions. Thus, a user can selectively move the valve between the first and second positions, facilitated by the switch. The switch can be one of a dial or a knob. Alternatively, the switch can be an electrical controller that, in one embodiment, can be operated by a remote control unit.

The traveling sprinkler can further include a first hose connected at one end to the inlet of the supply piping. The other end of the first hose can be connected to a fluid source such that a fluid can be supplied to the supply piping. In addition, embodiments of the invention can include a second hose having opposing ends. The second hose can be connected at one end to the outlet end of the discharge piping.

In one embodiment, the traveling sprinkler can include a housing attached to either the hose reel or the wheeled carriage. The housing can enclose at least a portion of the valve, the sprinkler head, and the discharge piping.

DETAILED DESCRIPTION OF EMBODIMENTS OF THE INVENTION

Aspects of the present invention relate to a traveling sprinkler system that expands the range of possible uses for traveling sprinklers. Embodiments of the invention will be explained in the context of one possible traveling sprinkler assembly, but the detailed description is intended only as exemplary. Embodiments of the invention are shown in FIGS. 1–6, but the present invention is not limited to the illustrated structure or application.

Figure 1:
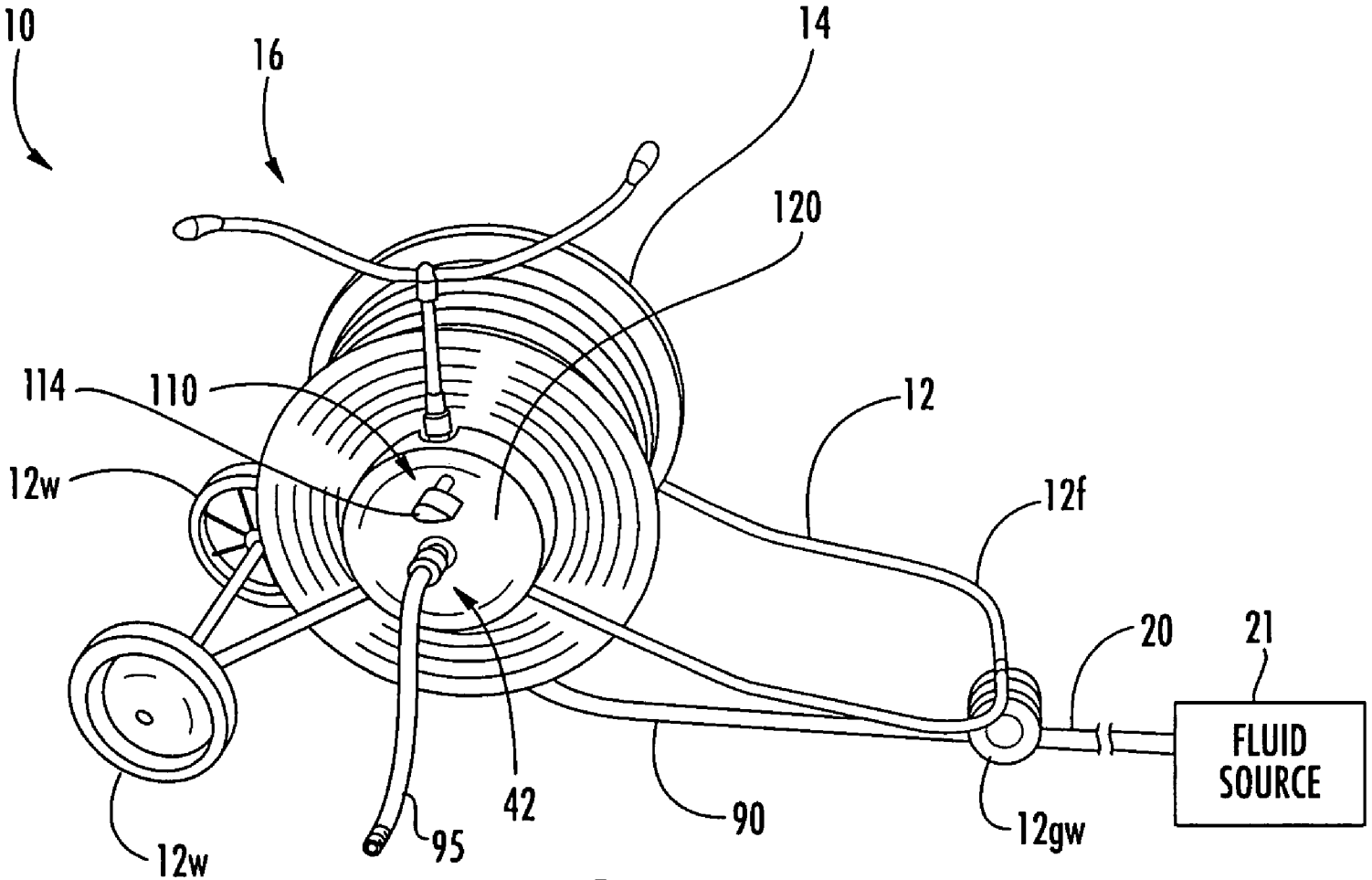
FIG. 1 is an isometric view of an embodiment of a traveling sprinkler according to the invention.
Figure 2:
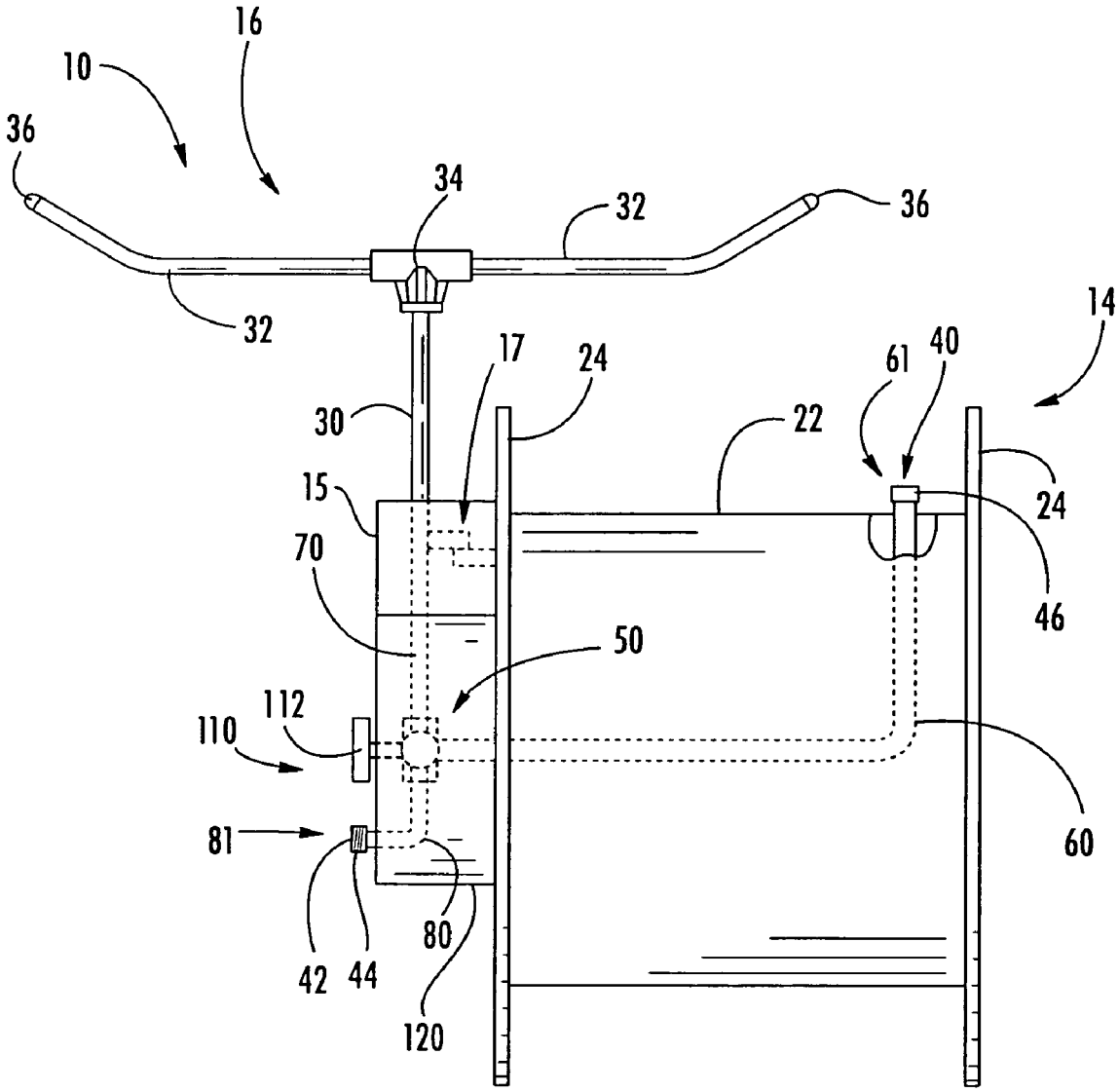
FIG. 2 is a side elevational view of an embodiment of a traveling sprinkler according to the invention.

Referring to FIGS. 1 and 2, a traveling sprinkler assembly 10 according to the invention can include a wheeled frame 12, a hose reel 14, a rotating sprinkler head 16, and a transmission 15 for communicating the rotation of the sprinkler head 16 to the hose reel 14 so as to propel the sprinkler assembly 10. Though well known in the art, each of these components will be briefly discussed in turn below.

The wheeled frame 12 or carriage can include a frame 12*f* having one or more associated wheels 12*w*, 12*gw* (hereafter collectively referred to as "W"). The frame 12*f* can be a rigid structure that is made of any of a number of materials such as plastics, composites, metals, wood or any combination of these and other materials. The frame 12*f* may be a unitary structure, or it can be a multi-part assembly. The frame 12*f* can but need not be a continuous piece. The frame 12*f* can have any of a number of confirmations and embodiments of the present invention are not limited to any specific frame configuration.

The frame 12*f* can have one or more wheels W associated with it. In one embodiment, the frame 12*f* can have at least two wheels. In another embodiment, shown in FIG. 1, the frame 12*f* can have three wheels W including one wheel 12*gw* for guiding the assembly along an uncoiled length of hose 20 as it travels back to a fluid source 21. Each wheel W can be associated with the frame by an individual axle or, in some instances, two or more wheels can share a common axle (such as wheels 12*w*). The wheels W can also be castors associated with the frame 12*f*.

Another component of the traveling sprinkler assembly 10 is the hose reel 14. The hose reel 14 can comprise a drum 22, which can be generally cylindrical or any other confirmation so long as it is adapted to have a hose wound around it and/or to facilitate the take up of unwound hose. The hose reel 14 can also include opposing side plates 24 joined to the drum 22. As will be described below, the hose reel 14 can be solid or hollow, through which one or more components can extend or protrude. The hose reel 14 can be made of various materials such as metals or plastics. Further, the hose reel 14 can be directly or indirectly mounted on the wheeled frame 12 such that at least a portion of the hose reel 14 can freely rotate. Indirect mounting means that the hose reel 14 can be mounted to the wheeled frame 12 by one or more intermediate components, such as the transmission 15, which may be directly mounted to at least a portion of the wheeled frame 12. One manner in which the hose reel 14 can be mounted on the wheeled frame 12 is disclosed in U.S. Pat. No. 3,430,859 at column 4, lines 13–66, and FIGS. 2 and 4, which is incorporated herein by reference.

Yet another component of the traveling sprinkler assembly is a sprinkler head 16. The sprinkler head 16 can have any of a number of configurations, as would be appreciated by those skilled in the art. In one embodiment, the sprinkler head 16 includes at least a hollow shaft 30 and pair of spray arms 32 connected to the shaft by a t-connector 34. The spray arms 32 can be arranged generally opposite to each other and can be generally perpendicular to the shaft 30. The spray arms 32 can include nozzles 36 at their free ends. Thus, as water is supplied to the sprinkler head 16 through the shaft 30, the water is ejected under pressure in opposite directions so as to cause the sprinkler head 16 to revolve. The nozzle ends 36 of the spray arms 32 can be shaped, positioned or otherwise configured to facilitate rotation of the sprinkler head 16. One example of a sprinkler head 16, its associated components and the manner in which the sprinkler head 16 can be mounted with respect to the rest of the traveling sprinkler assembly 10 is described in the '859 patent at column 2, line 65-column 3, line 25 and FIGS. 2–4, which is incorporated by reference. The sprinkler head 16 can also be a reciprocating sprinkler, which is known in the art.

A sprinkler assembly 10 according to aspects of the invention can include a transmission or drive 15 for communicating the rotation of the sprinkler head 16 to the hose reel 14 so as to cause the hose reel 14 to rotate. The rotation of the hose reel 14 in turn causes the attached hose 20 to wind up onto the hose reel 14, which, in turn, propels the traveling sprinkler assembly 10. It should be noted that when the sprinkler head 16 is not rotating, such as when water is prevented from entering the sprinkler head 16, the transmission system 15 is not activated and, thus, the travel function of the sprinkler assembly 10 is not engaged and the assembly 10 will not travel.

The transmission 15 can be any system for communicating the rotation of the sprinkler head 16 to cause at least a portion of the hose reel 14 to rotate. In one embodiment, the transmission 15 can include at least a plurality of gears 17. Examples of transmissions for traveling sprinklers, and the manner in which they interact with other components of the traveling sprinkler assembly, are disclosed in the following references, which are incorporated by reference: the '156 patent at column 4, line 23 through column 5, line 2; the '056 patent at column 1, line 59 through column 3, line 22; and, preferably the '859 patent at column 3, line 25–column 4, line 13. Naturally, all of the associated drawing figures from these patents are incorporated by reference as well. Again, these are merely examples of transmission systems and still other transmission systems are possible within the scope of the invention, as would be appreciated by one skilled in the art. In one embodiment, the transmission system 15 can be deactivated, such as by way of a user switch, so that the user can operate the sprinkler without having the hose reel travel. One manner of disengaging the transmission is disclosed in the '156 patent at column 5, lines 30–37, which is incorporated by reference.

Another component of a traveling sprinkler assembly according to aspects of the invention can include a flow control valve 50. The valve 50 can be almost any type of valve and, in one embodiment, the valve 50 can be a ball valve 55 (see FIG. 6). The operation of the valve will be described more fully below.

Supply piping 60 can have an inlet end 61 and can extend to the flow control valve 50. The inlet end 61 of the supply piping 60 can include a coupling 40 adapted for connection to a hose. Thus, the supply piping 60 is adapted to be connected at one end to the coupling 40 or a hose and at the other end to the flow control valve 50. The coupling 40 can be integral with the supply piping 60. The coupling 40 can be located on the hose reel 14. For example, the coupling 40 can be located on the outer surface of the drum portion 22 of the hose reel 14.

The supply piping 60 can be any conduit so long as it can channel water or other fluid from the coupling 40 to the flow control valve 50. The supply piping 60 can be made of any material, such as metals or plastics. Further, the supply piping 60 is not limited to any particular cross-sectional geometry. In addition, the supply piping 60 can have any overall shape depending on the relative positioning of the coupling 40 and the valve 50. For example, as shown in FIG. 2, the coupling 40 can protrude radially outward from the hose reel 14, and the valve 50 can be located on one side of the hose reel 14. In such case, the supply piping 60 can include one or more bends. In other configurations, the supply piping 60 can be straight. Further, the supply piping 60 can be a single pipe or made up of two or more pipe segments.

Additional components of an embodiment of the invention include sprinkler piping 70 and discharge piping 80. The sprinkler piping 70 can extend between the flow control valve 50 and the sprinkler head 16. The sprinkler piping 70 can include at least a portion of the hollow shaft 30 of the sprinkler head 16. The discharge piping 80 can extend from the flow control valve 50 to an outlet end 81. The outlet end 81 of the discharge piping 80 can include a coupling 42. In one embodiment, the coupling 42 can be adapted for connection to a hose such as a garden hose.

In one embodiment, a first hose 90 can be connected at one end to the coupling 40 on the supply piping 60. At its other end, the first hose 90 can be connected to a water supply, such as a water faucet, or other fluid source 21. The first hose 90 can supply water or other fluid to at least the supply piping 60. Embodiments of the invention can further include a second hose 95 or flexible fluid conduit connected at one end to the coupling 42 on the discharge piping 80. However, embodiments of the invention are not limited to attaching a hose to the coupling 42. Other watering devices or fluid dispensing devices can be attached to the coupling 42. Examples of other devices include any cleaning tools that are used to clean vehicles, driveways, windows, the side of the house, to name a few. Fluid dispensing devices can further include any stationary irrigation tools for flowerbeds or vegetable gardens. Additional devices can include any water dispensing tools to fill containers like water-drinking bowls for animals or swimming pools or any other attachments known in the industry as "hose ends."

Again, embodiments of a traveling sprinkler assembly 10 according to the invention can include at least the couplings 40, 42. Each of the couplings 40,42 can be adapted for connection to a water conduit, such as a common garden hose or any other type of hose, or other fluid-related equipment. The couplings 40,42 can be, for example, male or female threaded connectors 44 (see FIGS. 2–5) or they can be quick connect/disconnects 46 (see FIGS. 2 and 6). Preferably, the couplings 40,42 can aid in effecting a good water seal between parts.

The coupling 40 can generally serve as a connection station for a first fluid supply conduit, such as a garden hose that is connected to a water source. In one embodiment, the coupling 40 can be positioned on the hose reel 14. For instance, the coupling 40 can extend radially outward from the drum portion 22 of the reel 14. The coupling 42 can generally serve as a connection station for a second fluid conduit 95 so as to discharge water from the traveling sprinkler assembly 10. In one embodiment, the coupling 42 can be located on one side of the hose reel 14, such as proximate to one of the side plates 24.

Figure 3:
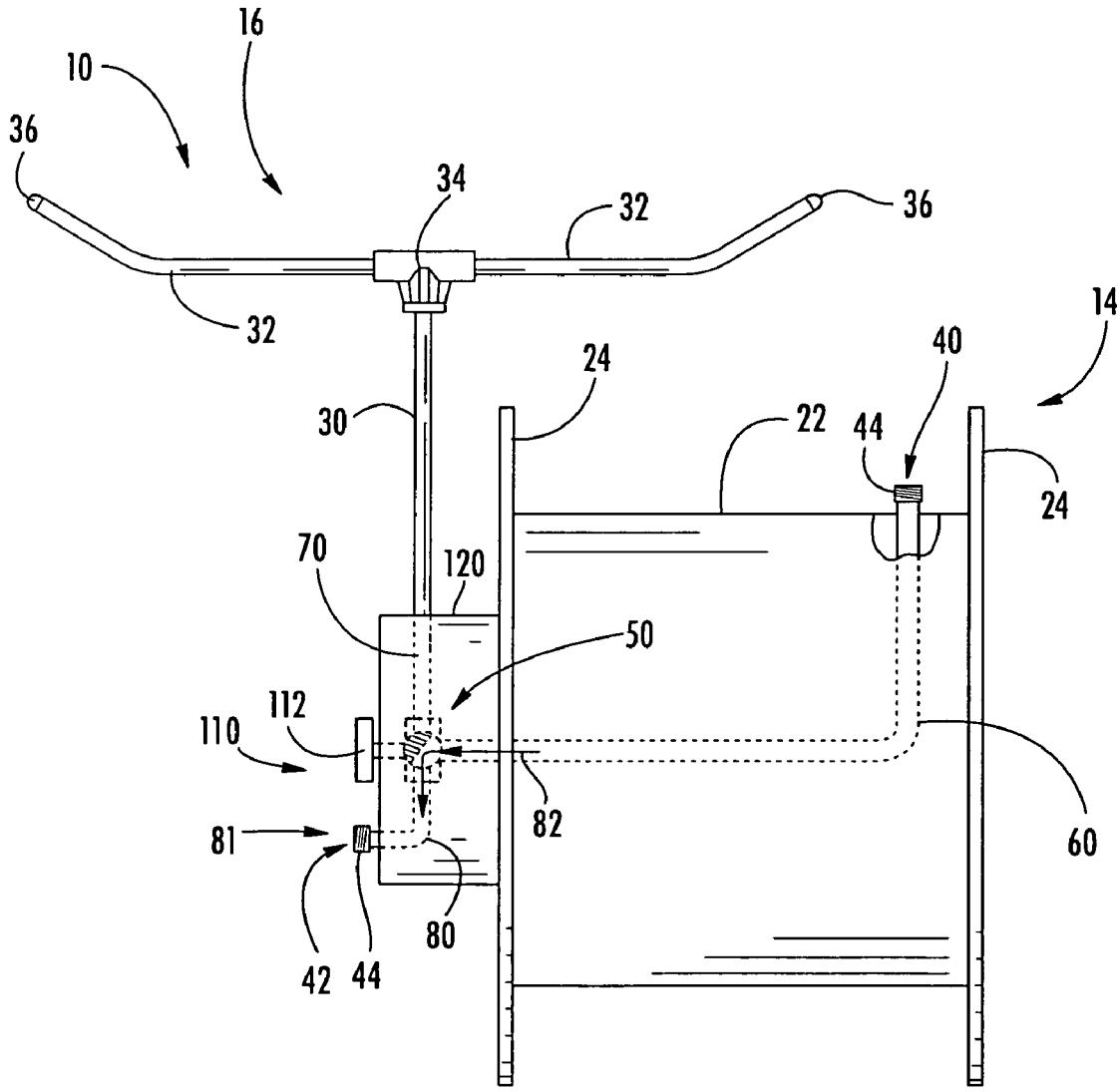
FIG. 3 is a side elevational view of an embodiment of a traveling sprinkler according to the invention, showing a valve in a first position.
Figure 4:
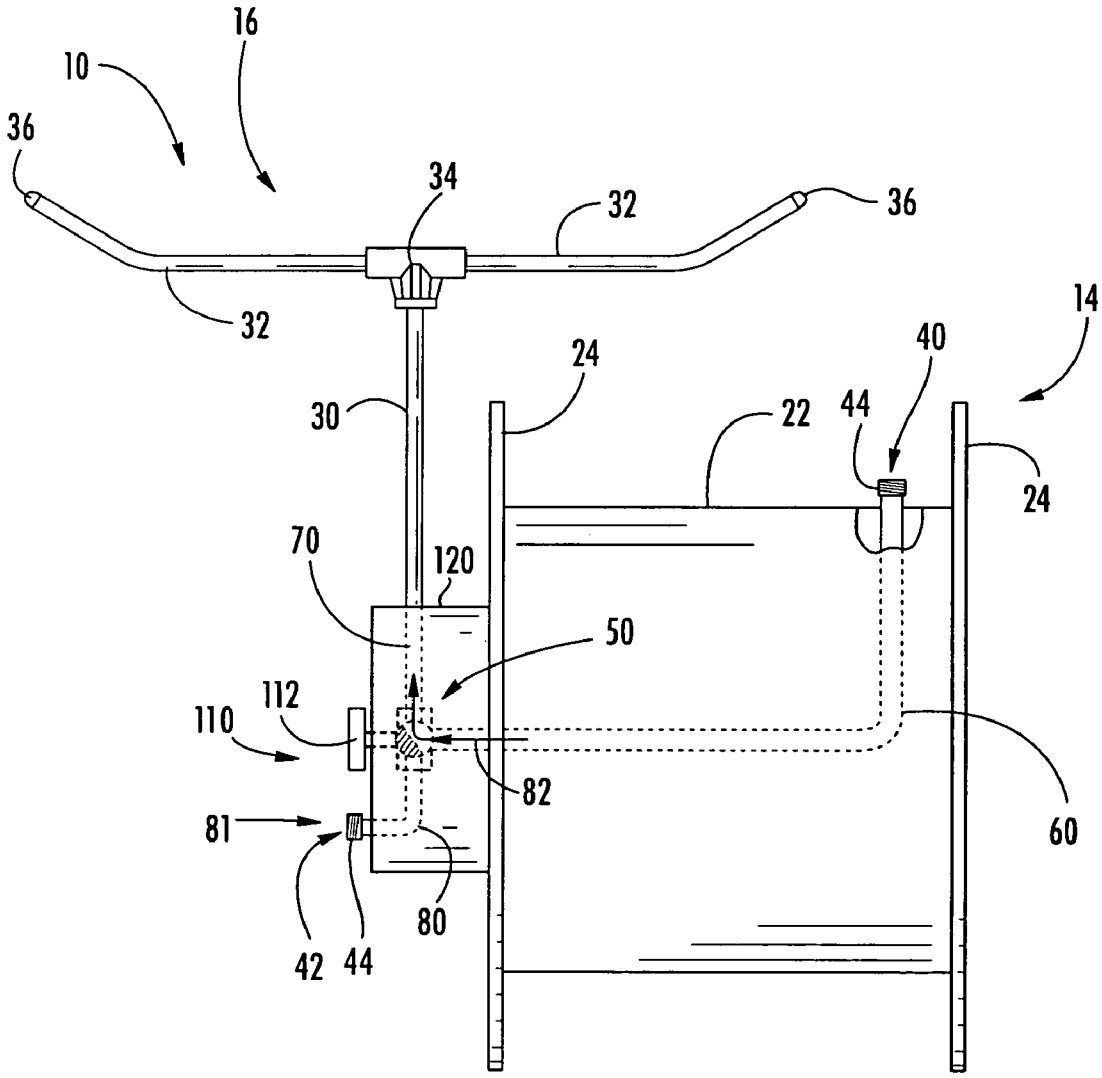
FIG. 4 is a side elevational view of an embodiment of a traveling sprinkler according to the invention, showing the valve is in a second position.
Figure 5:
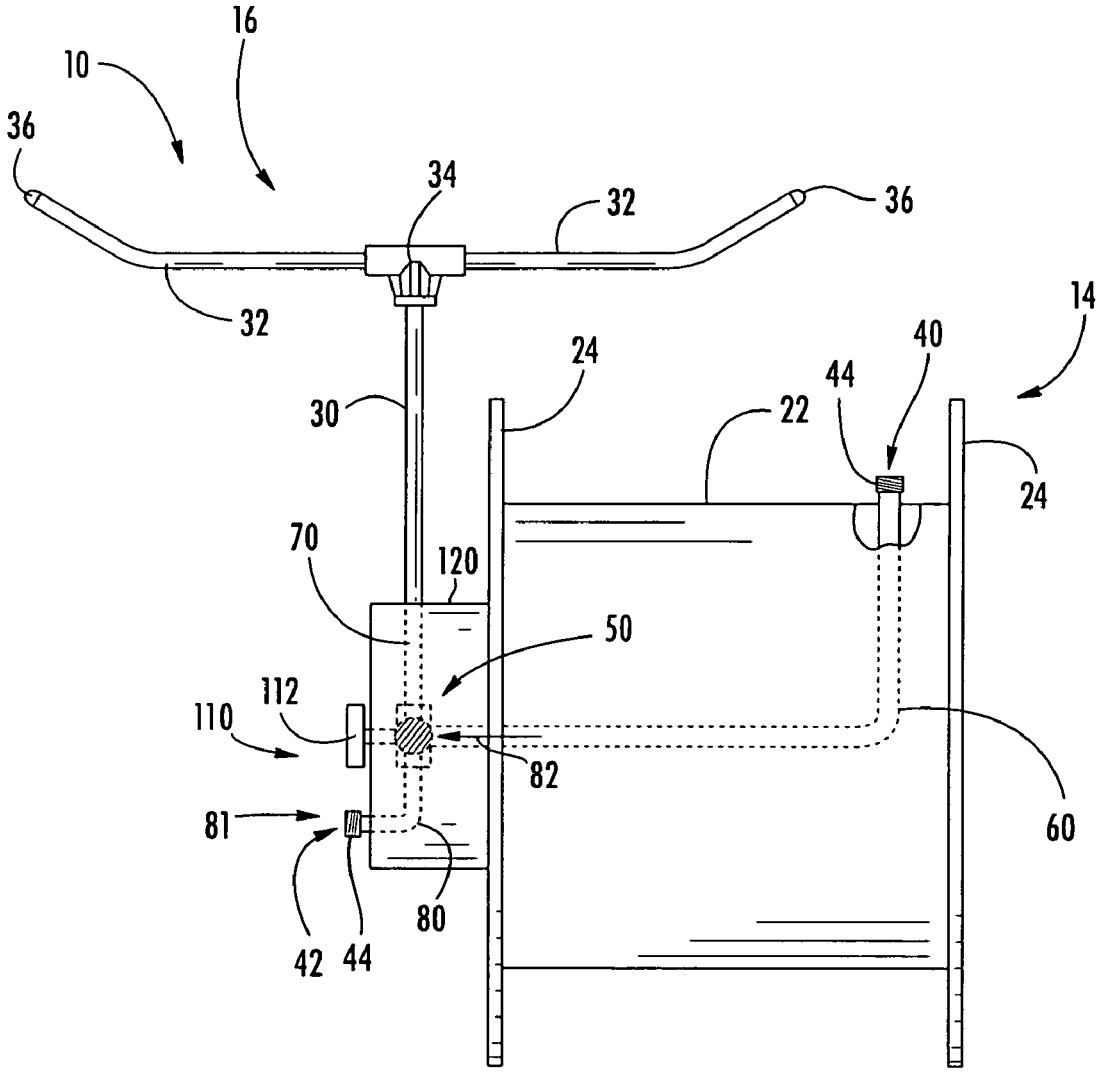
FIG. 5 is a side elevational view of an embodiment of a traveling sprinkler according to the invention, showing the valve is in a third position.

The valve 50 is movable at least between a first position and a second position. In the first position, fluid communication can be permitted substantially exclusively between the supply piping 60 and the discharge piping 80, as shown in FIG. 3. In other words, water 82 or other fluid from the supply piping 60 is restricted from being supplied to the sprinkler head 16 through sprinkler piping 70; consequently, the sprinkler head 16 will not rotate and the assembley 10 will not travel because the transmission 15 will not be activated. In the second position, fluid communication can be permitted substantially exclusively between the supply piping 60 and the sprinkler piping 70, as shown in FIG. 4. In one embodiment, the valve 50 can be further movable to a third position in which the supply piping 60 is substantially restricted from fluidly communicating with both the discharge piping 80 and the sprinkler piping 70, as shown in FIG. 5.

Figure 6:
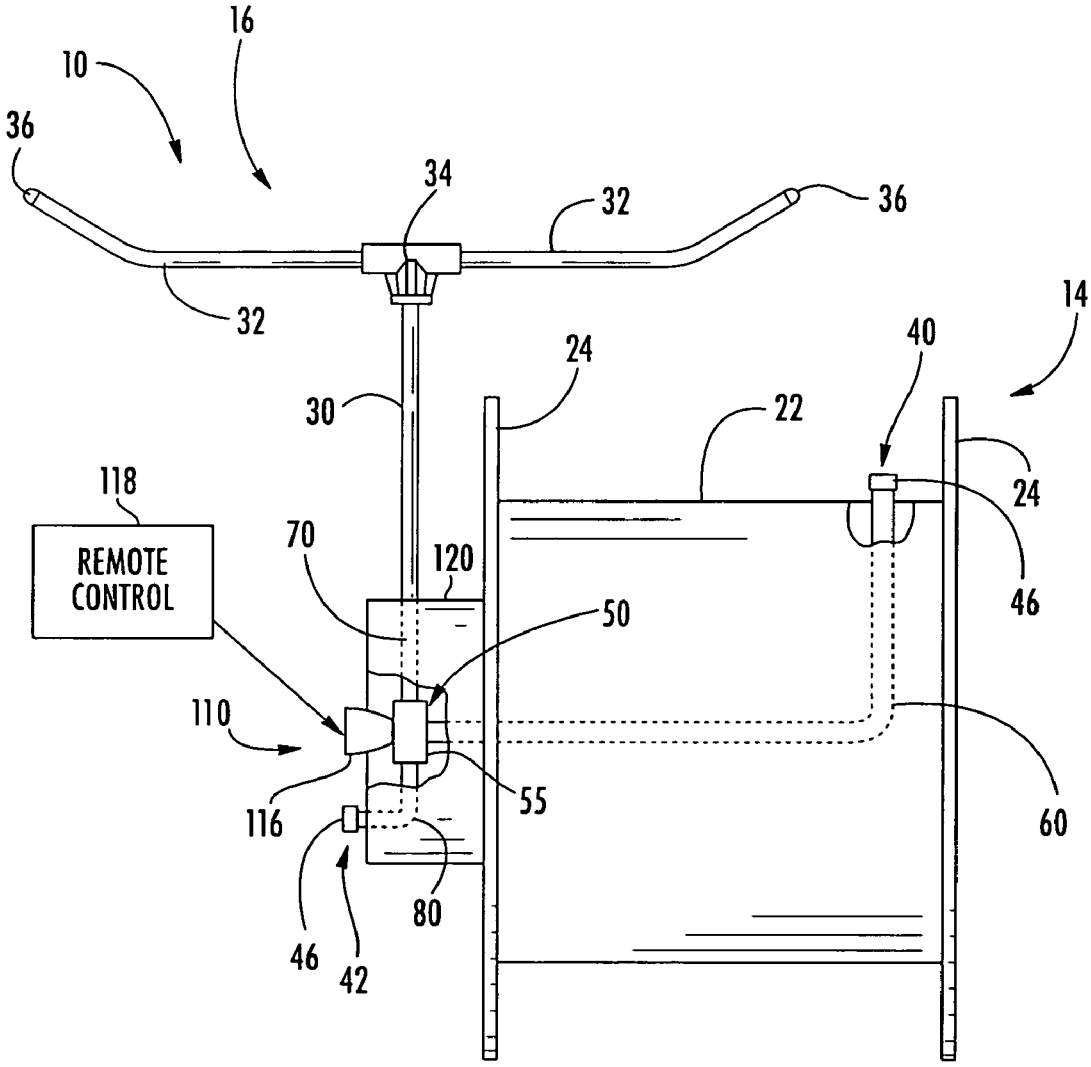
FIG. 6 is a side elevational view of an embodiment of a traveling sprinkler according to the invention, showing an electronic controller that is operatively connected to a valve and that is operated by a remote control unit.

A traveling sprinkler 10 according to aspects of the invention can further include a flow control switch 110. The flow control switch 110 can be operatively connected to the flow control valve 50. Thus, a user can selectively move the flow control valve 50 between the first, second, and/or third positions by turning the switch 110. The switch can be a mechanical switch, such as knob 112 (as shown in FIGS. 2–6) or dial 114 (as shown in FIG. 1), that a user can operate by hand. Alternatively, the switch 110 can be an electronic controller 116 that a user can interface or operate directly or remotely, such as by telemetry or a remote control device 118, as shown in FIG. 6.

Depending on the location of the individual components of the invention, an embodiment of the invention can include a housing 120. For example, when the sprinkler head 16, valve 50, and discharge piping 80 are disposed on one side of the hose reel 14, as shown in FIG. 2, the housing 120 can be provided to enclose at least a portion of each of these components to prevent damage, vandalism, and exposure to external conditions. The housing 120 can be made of any material, such as metal or plastic, and can be secured to the hose reel in any of a number of manners. The housing 120 can include various markings to inform a user of any of a number of things including the various operational setting positions for the valve 50.

Again, the above-described individual components can be assembled in a variety of manners, and the embodiments shown in FIGS. 1–6 are just a few examples.

A traveling sprinkler according to aspects of the invention can be used in a variety of ways. For example, the sprinkler assembly 10 can be reeled out to the desired spot in the yard. In doing so, the user can switch the valve 50 to the third position so that water is prevented from being discharged from the sprinkler head 16 or the outlet end 81 of the discharge piping 80. Once in the desired position, a user has several options. For instance, the user can set the valve 50 to the second position. As a result, water will enter and be discharged from the sprinkler head 16, causing the sprinkler head 16 to rotate. Thus, the assembly 10 can wind back and operate like the conventional traveling sprinklers known in the art. Alternatively, the valve 50 could be set to the first position and a user could attach a second hose 95 to the coupling 42 provided at the outlet end 81 of the discharge piping 80. Thus, a user can use the second hose 95 for watering tasks such as washing a car, cleaning the driveway, watering hanging baskets, and/or any of the tasks previously described.

As is known in the art, a mechanical shut off valve can be provided on the hose near the water source to prevent the sprinkler from climbing to the faucet or other fluid source.

As will be appreciated by one of skilled in the art, aspects of the invention can be applied to almost any traveling sprinkler system like those disclosed in U.S. Pat. Nos. 3,126,156; 3,430,859; 2,683,056; and 5,711,490, which are incorporated herein by reference. It will of course be understood that the invention is not limited to the specific details described herein, which are given by way of example only, and that various modifications and alterations are possible within the scope of the invention as defined in the following claims.

What is claimed is:

1. A traveling sprinkler apparatus comprising:

a wheeled frame;

a hose reel rotatably mounted on the frame;

a rotatable sprinkler head;

a transmission for communicating the rotation of the sprinkler to the hose reel such that the hose reel rotates;

a flow control valve;

supply piping having an inlet end and extending to the flow control valve;

sprinkler piping extending between the flow control valve and the sprinkler head; and discharge piping extending from the flow control valve to an outlet end;

wherein the valve is movable at least between a first position and a second position, wherein, in the first position, fluid communication is permitted substantially exclusively between the supply piping and the discharge piping, whereby a fluid enters the discharge piping and is discharged from the outlet end of the discharge piping such that the sprinkler apparatus does not travel, wherein, in the second position, fluid communication is permitted substantially exclusively between the supply piping and the sprinkler piping, whereby a fluid enters and is discharged from the sprinkler head such that the sprinkler head rotates, which, by way of the transmission, causes the sprinkler apparatus to travel.

2. The traveling sprinkler of claim 1 further comprising:

a flow control switch, wherein the flow control switch is operatively connected to the flow control valve so as to move the flow control valve between the first and second positions, whereby a user can selectively move the valve between the first and second positions.

3. The traveling sprinkler apparatus of claim 2 wherein the switch is one of a dial or a knob.

4. The traveling sprinkler apparatus of claim 2 wherein the switch is an electrical controller.

5. The traveling sprinkler apparatus of claim 4 wherein the controller is operated by a remote control unit.

6. The traveling sprinkler of claim 1 further including a first hose connected at one end to the inlet of the supply piping, whereby the other end of the first hose is connected to a fluid source such that a fluid can be supplied to the supply piping.

7. The traveling sprinkler of claim 6 further including a second hose having opposing ends, wherein the second hose is connected at one end to the outlet end of the discharge piping.

8. The traveling sprinkler of claim 1 wherein the flow control valve is a ball valve.

9. The traveling sprinkler of claim 1 wherein the inlet end of the supply piping includes a coupling adapted for connection to a hose.

10. The traveling sprinkler of claim 9 wherein the coupling is located on the hose reel.

11. The traveling sprinkler of claim 10 wherein the coupling includes one of threads or quick disconnects.

12. The traveling sprinkler of claim 1 wherein the outlet end of the discharge piping includes a coupling adapted for connection to one of a hose or a fluid dispensing device.

13. The traveling sprinkler of claim 12 wherein the coupling includes one of threads or quick disconnects.

14. The traveling sprinkler of claim 1 wherein the transmission includes at least a plurality of gears.

15. The traveling sprinkler of claim 1 wherein the valve is further movable to a third position, wherein the supply piping is substantially restricted from fluidly communicating with the discharge piping and the sprinkler piping.

16. The traveling sprinkler of claim 1 further including a housing attached to one of the hose reel or the wheeled carriage, wherein the housing encloses at least a portion of the valve, the sprinkler head, and the discharge piping.

* * * * *